US005841073A

United States Patent [19]

Randa et al.

[11] Patent Number: 5,841,073

[45] Date of Patent: Nov. 24, 1998

[54] PLENUM CABLE

[75] Inventors: Stuart Karl Randa, Wilmington, Del.; George Martin Pruce, Glastonbury, Conn.

[73] Assignee: E. I. du Pont de Nemours and Company, Wilmington, Del.

[21] Appl. No.: 708,440

[22] Filed: Sep. 5, 1996

[51] Int. Cl.[6] ..... H01B 11/02

[52] U.S. Cl. ..... 174/113 R; 174/121 A

[58] Field of Search ..... 174/113 R, 105 R, 174/107, 110 PM, 110 V, 110 FC, 110 F, 121 A

[56] References Cited

U.S. PATENT DOCUMENTS

| | | | |
|---|---|---|---|
| 3,945,974 | 3/1976 | Schwarcz et al. | 260/31.8 R |
| 4,412,094 | 10/1983 | Dougherty et al. | 174/110 F |
| 5,162,609 | 11/1992 | Adriaenssens et al. | 174/34 X |
| 5,270,486 | 12/1993 | Chan et al. | 174/23 R X |
| 5,493,071 | 2/1996 | Newmoyer | 174/113 R |
| 5,514,837 | 5/1996 | Kenny et al. | 174/113 R |
| 5,576,515 | 11/1996 | Bleich et al. | 174/110 PM |
| 5,597,981 | 1/1997 | Hinoshita et al. | 174/110 R |

*Primary Examiner*—Bot L. Ledynh
*Assistant Examiner*—Chau N. Nguyen

[57] ABSTRACT

A plenum cable is provided which passes the category 5 requirements, including the UL 910 burn/smoke test, the cable containing at least four twisted pairs of insulated conductors, the insulation of one of the pairs of insulated conductors being foamed polyolefin which is free of flame retardant additive and the insulation of the other three twisted pairs of insulated conductors being fluoropolymer, the cable having a skew between twisted pairs of no greater than 30 nanoseconds.

4 Claims, 1 Drawing Sheet

PLENUM CABLE

FIELD OF THE INVENTION

This invention relates to category 5 plenum cable.

BACKGROUND OF THE INVENTION

Category 5 plenum cable made of jacketed twisted pairs of insulated conductors has to satisfy a number of electrical requirements set by the EIA/TIA specification 568A, including having an attenuation of not more than 22 dB/100 m at 100 MHz and more recently, not more than 48.5 dB/100 m at 400 MHz, and having a skew between twisted pairs of less than 50 nanoseconds/100 meters of cable and the National Electric Code (NEC) requirement of the cable passing the UL 910 burn/smoke test. Skew is the difference in time for an electrical signal to travel along a given length of a twisted pairs and is affected by the dielectric constant of the insulation on the conductors and the degree of twist forming the twisted pairs. It is normally desired to vary the twist of the conductors forming each twisted pair so as to minimize cross-talk between twisted pairs. The shorter the twist, e.g. two turns/inch (2.54 cm), the longer the signal path for the length tested for skew, leading to a slightly longer time for the signal to travel along this length of twisted pair. Conversely, the looser the twist, e.g. two turns/1.5 in (3.81 cm), the shorter the signal path. The looseness or tightness of the twist is often referred to as the lay of the twist, e.g. "long lay" is used to refer to a loose twist. Dielectric constant is a characteristic of the particular insulation material present on the conductors and is related to skew expressed in nanoseconds. i.e. as the difference between dielectric constant increases for two different twisted pairs, skew between the twisted pairs also increases.

The industry standard for insulation material for conductors in cable composed of multiple twisted pairs of conductors has been fluoropolymer, notably tetrafluoroethylene/hexafluoropropylene copolymer (FEP) and tetrafluoroethylene/perfluoro(alkyl vinyl ether) copolymer (PFA). Insulation of these fluoropolymers pass the UL 910 burn/smoke test (as well as the other category 5 tests) whereas insulation of other polymers does not.

U.S. Pat. No. 5,514,837 discloses a plenum cable made of a plurality of twisted pairs of insulated conductors wherein at least one of the twisted pairs of conductors is insulated with fluoropolymer and at least one of a different twisted pair is insulated with flame retardant, foamed polyolefin to provide a cable wherein the skew between twisted pairs is characterized by a dielectric constant range of +or −0.25, i.e. the skew falls within the dielectric constant range of 0.5 with respect to slowest and fastest signal transmission of the twisted pairs of the plenum cable. Polyolefin insulation normally exhibits a dielectric constant of about 2.3, while fluoropolymer insulation normally exhibits a dielectric constant of about 1.93 to 1.98. Polyolefin insulation is normally tight on the conductor while fluoropolymer insulation tends to be slightly loose on the conductor. The skew when these insulation materials are mixed in the same plenum cable in the '837 patent is a result of foaming of the polyolefin, which reduces its dielectric constant to be closer to that of the fluoropolymer. Ability of the resultant cable to pass the UL 910 test is achieved by the polyolefin containing flame retardant additive. In this regard, the patent discloses chlorinated flame retardant agents for use in the polyolefin but prefers a complex system which is non-chlorinated and consisting of a mixture of metal compounds and a flame retardant intumescent.

Even a smaller skew is desired to facilitate of increasing complex equipment being operated by the signal from the plenum cable.

SUMMARY OF THE INVENTION

It has been found that category 5 plenum cable comprising at least four twisted pairs of insulated conductors can pass the UL 910 burn/ smoke test and satisfies the other category 5 requirements when the insulation of only three of the twisted pairs is fluoropolymer and the insulation of the remaining twisted pair of the four comprises foamed polyolefin which is free of flame retardant additive. The skew between twisted pairs of the cable is no greater than 30 nanoseconds, and in accordance with the present invention the plenum cable can be designed so that there is virtually no skew between twisted pairs. This skew expressed in time delay between the slowest and fastest signal transmission time of the twisted pairs of the cable, measured on 100 m length of cable in accordance EIA/TIA specification 568A, corresponds to a skew of about 0.25 (total range) expressed as difference between dielectric constants.

The cable is also jacketed, but with conventional jacket thickness, e.g. 16 mils (0.406 mm) thick flame retardant polyvinyl chloride (PVC), rather than 30 mil (0.762 mm) thick flame retardant PVC. In other words, a greater thickness of the jacket is not required to pass the UL 910 burn/smoke test even though polyolefin is present, which by itself will not pass this test. Surprisingly, the cable of the present invention passes the UL test without requiring a jacket thickness greater than 20 mils (0.508 mm). In the case of fluoropolymer jacketing, such as of FEP or ethylene/chlorotrifluoroethylene copolymer (ECTFE), much thinner jacket thicknesses can be used.

The omission of flame retardant additive from the foamed polyolefin insulation has an effect on dielectric constant. Flame retardant additive increases dielectric constant, which means that the polyolefin must be foamed to a higher void content, meaning less polyolefin being present for exposure to the UL test. Omission of the flame retardant additive from the polyolefin in the present invention means that the polyolefin is foamed less than would otherwise be possible if the additive were present. Surprisingly the resultant greater amount of polyolefin present in the foamed insulation still enables the plenum cable to pass the UL test as well as to satisfy the remaining requirements for the category 5 rating.

Because of the variation in twist present in the twisted pairs making up the plenum cable, one of the twisted pairs will have the loosest twist (longest lay), thereby having the least loss in signal transmission speed as compared to the remaining twisted pairs. An increase in the dielectric constant of the insulation on this twisted pair has the effect of slowing down the signal transmission speed to reduce the skew as compared with the other twisted pairs. Preferably, the longest-lay twisted pair is the pair that is insulated with the foamed polyolefin. Surprisingly, the resultant sacrifice in (a reduction in) void content to match the dielectric constant of the fluoropolymer-insulated wires still enables the plenum cable to pass the UL test.

DETAILED DESCRIPTION OF THE INVENTION

Figure 1:
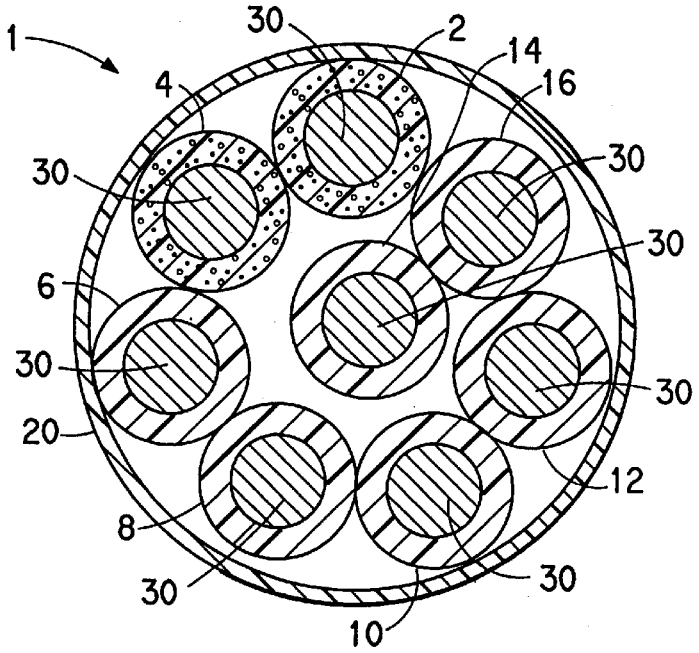
Fig. 1 is a cross section of one embodiment of plenum cable of the present invention in which four twisted pairs of insulated conductors are present.

A cable 1 composed of insulated conductors 2, 4, 6, 8, 10, 12, 14, and 16 within jacket 20 is shown in FIG. 1. Insulated conductors 2 and 4, 6 and 8, 10 and 12, and 14 and 16 are twisted pairs of cable and each of these twisted pairs are bunched together to form the bundle of four twisted pairs contained within the jacket 20. The term "conductor" used herein refers to the metal current-carrying component of the cable; sometimes such insulated conductor is called a primary. In FIG. 1 the conductors of each twisted pair is indicated as 30. The jacketed bundle of twisted-pair cables can contain more than four twisted pairs, e.g. 25 twisted pairs, wherein there would be 6 bundles of 4 twisted pairs and one extra twisted pair which would form the center of the cable. This center twisted pair can be the foamed polyolefin insulated conductors but preferably is of fluoropolymer-insulated conductors and still constitute a plenum cable of the present invention.

In accordance with the present invention, the insulation of one of the twisted pairs of insulated wires is foamed polyolefin which is free of flame retardant additive, while the remaining twisted pairs are insulated with fluoropolymer. In FIG. 1, the foamed polyolfin twisted pair is that which is composed of insulated conductors 2 and 4, and the twisted pairs 6 and 8, 10 and 12, 14 and 16 all have fluoropolymer insulation.

Figure 3A:
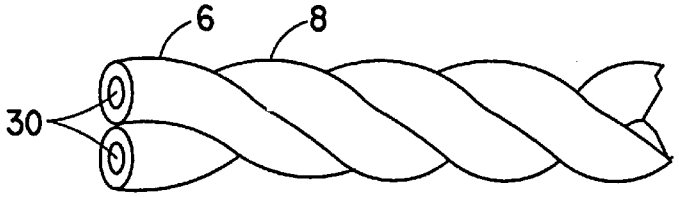
Fig. 3 is a length of two twisted pairs of insulated conductors, (a) illustrating a tight twist (tight lay) of the two insulated condustors making up the twisted pair and (b) illustrating a looser twist (longer lay).
Figure 3B:
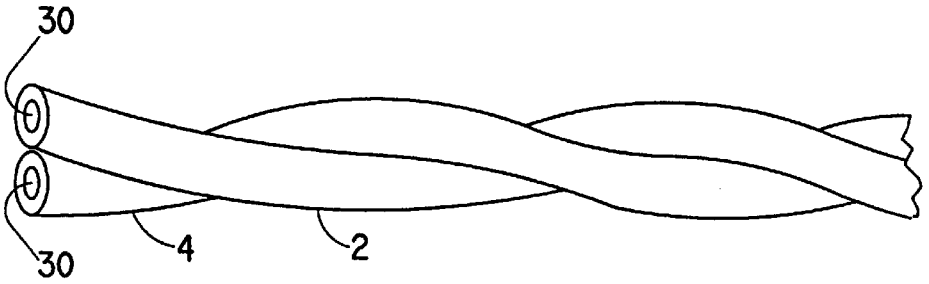

FIG. 3 shows a varying degree of twist in the insulated conductors making up each twisted pair. FIG. 3(*b*) shows a long lay twist which is preferred for the foamed polyolefin insulated conductors, and accordingly the conductors in FIG. 3(*a*) are numbered the same as the foamed polyolefin insulated conductors in FIG. 1. FIG. 3(*a*) represents the tighter twist for the twisted pair of conductors 6 and 8 insulated with fluoropolymer.

The polymers used in the present invention are well known. They are melt fabricable so as to be melt extrudable to form the insulation on the conductors or the jacket on the bundle of twisted pairs. The polymers also have sufficient molecular weight to provide the properties needed for the insulation or jacket, preferably exhibiting a tensile strength of at least 10 Mpa and elongation at break of at least 150%.

With respect to the fluoropolymer, FEP and PFA are preferred fluoropolymers, and these are perfluoropolymers. Typically the FEP copolymer will contain from 5 to 25 wt % hexafluoropropylene and the PFA polymer will contain 2 to 20 wt % of the perfluoro(alkyl vinyl ether). Preferred PFA copolymers are those wherein the alkyl group contains 2 or 3 carbon atoms, although alkyl groups containing 1 to 8 carbon atoms can be carbon atoms, although alkyl groups containing 1 to 8 carbon atoms can be used. The copolymers can contain additional comonomer in minor amounts to improve extrudability or physical properties. The fluoropolymer insulation is preferably solid, i.e. not foamed, but can also be foamed.

With respect to the polyolefin used to make the foamed insulation, a wide variety of polyolefins can be used, principally polyethylene and polypropylene, including copolymers of ethylene and propylene and/or with higher olefins containing e.g. 4 to 8 carbon atoms. Examples of polyolefins include the LLDPE type of polyethylene having a density of 0.905 to 0.925 g/cc, which is a copolymer of ethylene with a small amount of 1-butene or 1-octene. The polyolefin can contain small amounts of additives such as antioxidant and processing aid, which generally amount to less than 1 wt %. The polyolefin can also contain foam cell nucleating agent such as talc also in amounts generally less than 1 wt %. The polyolefin can be a single polyolefin or a blend of different polyolefins.

The fluoropolymer is extruded onto conductors in conventional manner and the insulated conductors are formed into twisted pairs and bundled together for jacketing also in conventional manner.

Figure 2:
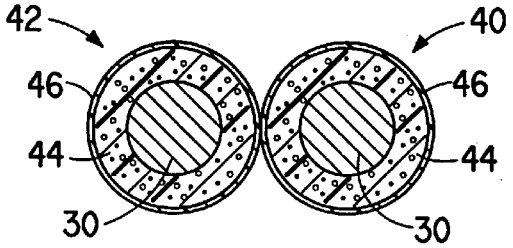
FIG. 2 is a cross section of one twisted pair of insulated conductors modified from the embodiment shown in FIG. 1.

The polyolefin insulation is also applied to conductors and foamed in a conventional manner, except for the preference in the present invention to have a solid exterior skin of polyolefin over the foamed polyolefin insulation. FIG. 2 shows a cross section of a twisted pair of insulated conductors 40 and 42, wherein the conductor is covered with foamed polyolefin insulation 44, which is in turn, covered by a solid skin 46 of polyolefin. The solid skin can be obtained by coextruding the polyolefin insulation, with the main body of the polyolefin being foamed and with the coextruded skin being solid (unfoamed). The solid skin helps provide structural integrity to the foamed polyolefin insulation, so as to maintain desired electrical performance. The solid skin also provides additional polyolefin resin being present in the polyolefin insulation, which works against passing the UL test, but surprisingly, even this embodiment of the present invention passes the test. The foamed polyolefin insulation may also include a thin inner solid skin of polyolefin, e.g. less than one mil (0.0254 mm), in contact with the conductor. The polyolefin insulated conductors are twinned and twisted to make twisted pairs by conventional process, preferably using the longest lay twist as compared to the twist present in the fluoropolymer insulated twisted pairs to which the foamed polyolefin insulated twisted pairs are to be bundled in a 3×1 ratio (fluoropolymer insulated twisted pairs/foamed polyolefin twisted pairs). The degree of foaming (void content) of the foamed polyolefin insulation is controlled by conventional means, e.g. amount of blowing agent added to the molten polymer at a given extrusion speed, so that the void content is effective to provide a skew of 30 nanoseconds or less with respect to the remaining twisted pairs present in the pleneum cable. Typically, to match the dielectric constant of the fluoropolymer insulation when solid, the void content of the polyolefin insulation will be from 10 to 30 %.

The diameter of each insulated conductor will be from 30 to 50 mils (0.762 to 1.27 mm), and the conductor will generally be from AWG 24 to AWG 22, which have diameters of 20 mils (0.51 mm) and 25.3 mils (0.643 mm), respectively, whereby the insulations will generally have a thickness of 5 to 15 mils (0.127 to 0.381 mm). More often, the insulation will have a thickness of 6 to 8 mils (0.152 to 0.203 mm). In the preferred embodiment, wherein a solid skin of polyolefin covering the foamed polyolefin insulation is used, the skin thickness will generally be from 0.2 to 1.0 mil (0.00508 to 0.0254 mm).

The jacket can be applied to the bundle of twisted pairs by conventional methods. A preferred jacket material is flame retardant PVC. Examples of flame retardant agents that are provided in PVC to make flame retardant jacket material are Technor Apex 910 and Gary 6921F1 which are believed to be a blend of chlorinated PVC, decabromodiphenylether, and molydenum trioxide. Also preferred are the fluoropolymer jackets such as of FEP or ECTFE, wherein the jacket thickness can be as little as 8 to 12 mils (0.203 to 0.305 mm) and no flame retardant additive is necessary.

Example 1

A twisted pair of foamed polyolefin conductors is prepared.

The polyolefin is polyethylene DGDL 3346 available from Union Carbide and contains 0.1 wt % of KS-8 ($F(CF_2)_8CH_2SO_3K$) nucleating agent. The polyolefin is extruded onto solid copper wire having a diameter of 20 mils (0.508 mm) under the following conditions: melt temperature of 285° C. and extrusion rate of 305 m/min, using nitrogen as the foaming gas. The thickness of the foamed insulation is 6.4 mils (0.162 mm) and the void content of the foam is 29%. The foamed insulation also has a solid outer skin of the same polyolefin, 0.7 mil (0.0179 mm) thick, obtained by foam/skin extrusion foaming using Nokia-Mailleffer foam/skin crosshead. The twist of the pair of so-insulated conductors forming the twisted pair is 0.6 turns/in (1.5 turns/cm) and the foam/skin insulation exhibits a dielectric constant of 1.85.

Three twisted pairs of insulated conductors are formed wherein the insulation on each conductor is FEP fluoropolymer having a melt flow rate of 22g/10 min. measured under standard conditions. The same conductor used for the foamed polyolefin-insulated conductors is used for the FEP insulated conductors. The thickness of the FEP insulation is 6.5 mils (0.165 mm) and the three twisted pairs have a twist ranging from about 0.3 to 0.6 turns/in (0.76 to 1.5 turns/cm).

A 3×1 plenum cable is prepared from the twisted pairs described above, with the extruded jacket being PVC containing Technor Apex 910 flame retardant agent, and with the jacket thickness being 15 mils (0.381 mm). The difference in twist of the FEP insulated conductors relates to a 8.8 nanosecond difference in signal transmission time, and the skew between the foamed polyolefin insulated twisted pair and the slowest of the FEP-insulated twisted pair is 18.8 nanoseconds, with the polyolefin insulated twisted pair having the fastest signal transmission. This represents a skew of 0.22 in dielectric constant for the plenum cable.

The cable passed the impedence, structural return loss and crosstalk tests for the category 5 rating as well as the attenuation test even when conducted at 60° C. The cable also passed the UL 910 burn/smoke test, exhibiting a maximum flame distance of 2.0 to 2.5 ft (61 cm), when 5 ft (152 cm) is allowed, a smoke peak optical density of 0.43 to 0.44, when a maximum of 0.5 is allowed, and smoke average optical density of 0.06, when 0.15 is allowed.

Example 2

The experiment of Example 1 is repeated except that the polyolefin foamed insulation of its respective twisted pair is characterized by a dielectric constant of 1.95. The result of this experiment is that the twisted pairs of the 3×1 cable exhibit dielectric constants from 1.92 to 1.96, i.e. range of only 0.04. This cable also passes the required electrical tests for category 5 rating, including the UL burn/smoke test.

We claim:

1. A category 5-rated plenum cable comprising at least four twisted pairs of insulated conductors, wherein the insulation of one of the at least four twisted pairs comprises foamed polyolefin which is free of flame retardant additive and the insulation of the remaining twisted pairs of the at least four twisted pairs is fluoropolymer, with the difference between dielectric constants of all the twisted pairs being no more than 0.25, said cable having a jacket having a thickness of no greater than 20 mils (0.508 mm), said jacket being flame retardant polyvinyl chloride.

2. The cable of claim 1 wherein said foamed polyolefin insulation has a solid exterior polyolefin skin.

3. The cable of claim 1 wherein said polyolefin is polyethylene.

4. The cable of claim 1 wherein said fluoropolymer is tertrafluoroethylene/hexafluoropropylene copolymer.

* * * * *